US011077573B2

(12) United States Patent
Rogers et al.

(10) Patent No.: US 11,077,573 B2
(45) Date of Patent: Aug. 3, 2021

(54) APPARATUS AND METHOD FOR CUTTING A TIRE INTO STRIPS, CUTTING TIRE STRIPS INTO CHIPS, AND STRIPPING A TIRE BEAD

(71) Applicant: Eco Green Eqiupment, LLC, North Salt Lake, UT (US)

(72) Inventors: Ted Bushman Rogers, Bountiful, UT (US); Michael Bradley Swenson, Salt Lake City, UT (US)

(73) Assignee: Eco Green Equipment, LLC, North Salt Lake, UT (US)

( * ) Notice: Subject to any disclaimer, the term of this patent is extended or adjusted under 35 U.S.C. 154(b) by 79 days.

(21) Appl. No.: 16/681,651

(22) Filed: Nov. 12, 2019

(65) Prior Publication Data

US 2021/0138675 A1 May 13, 2021

(51) Int. Cl.
*B26D 3/00* (2006.01)

(52) U.S. Cl.
CPC ..... *B26D 3/005* (2013.01)

(58) Field of Classification Search
CPC ..... B26D 3/005
USPC ..... 83/34, 951
See application file for complete search history.

(56) References Cited

U.S. PATENT DOCUMENTS 2,394,392 A * 2/1946 Mascarenhas ..... B26D 3/28 29/2.22
3,316,781 A * 5/1967 Bignell ..... H01B 7/36 81/9.51
4,914,994 A * 4/1990 Barclay ..... B29B 17/02 83/18

* cited by examiner

*Primary Examiner* — Kenneth E Peterson
*Assistant Examiner* — Liang Dong
(74) *Attorney, Agent, or Firm* — Travis R. Banta; TechLaw Ventures, PLLC

(57) ABSTRACT

An apparatus for cutting a whole tire into strips may include a cutting device having a first rotary blade and a second rotary blade. The tire is positioned between the first rotary blade and the second rotary blade, which cut the tire into one or more strips. The apparatus may further include a positioning system operable to orient the tire between a plurality of vertical, horizontal, and intermediate positions, relative to the cutting device. The apparatus may include one or more support rollers. The apparatus may further include a control system that controls the operation of the cutting device and tire positioning system as the tire is cut into strips by the cutting device. The apparatus may include a chipper to cut the tire strips into chips. The apparatus may include a bead peeler to remove the exterior rubber sheath from the wire bead.

12 Claims, 17 Drawing Sheets

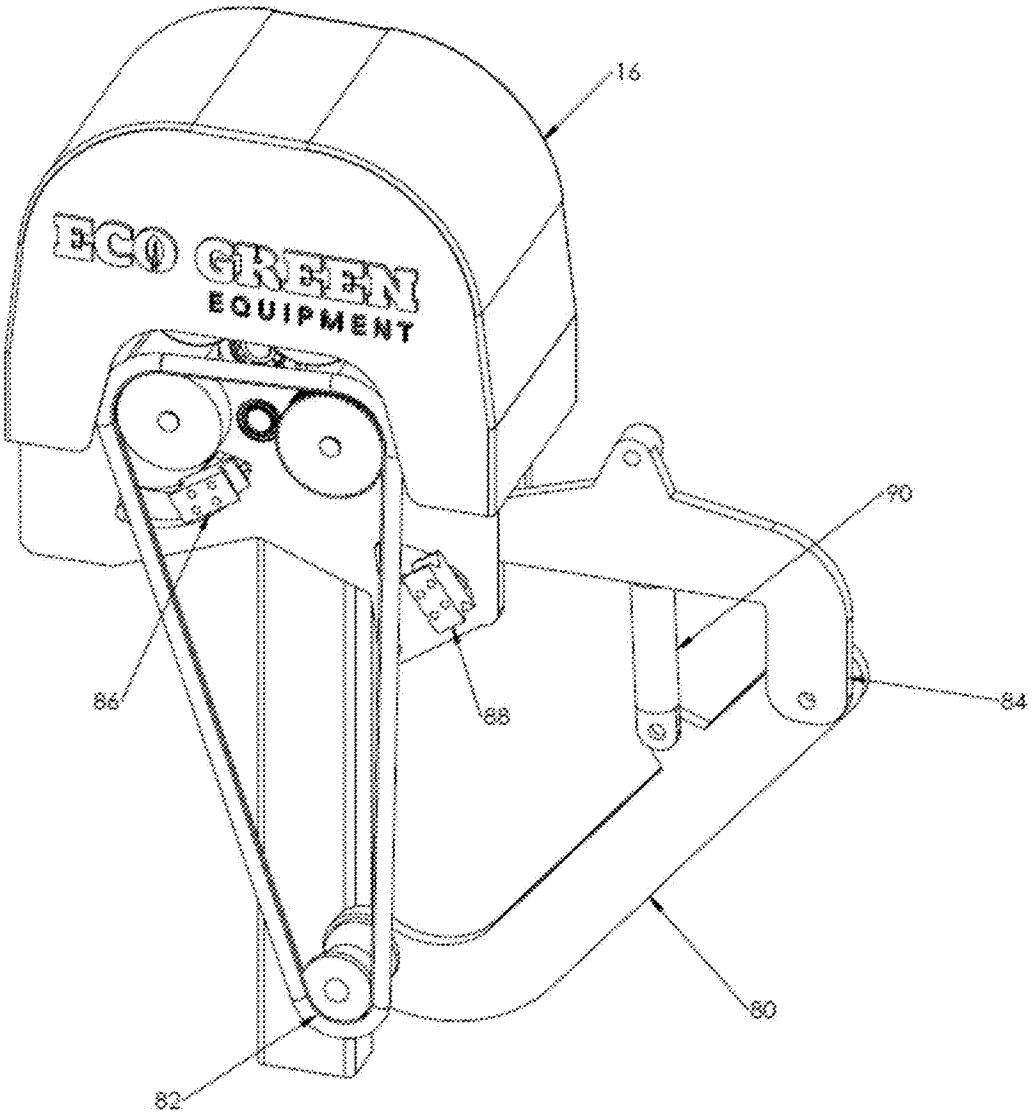
Fig. 8A
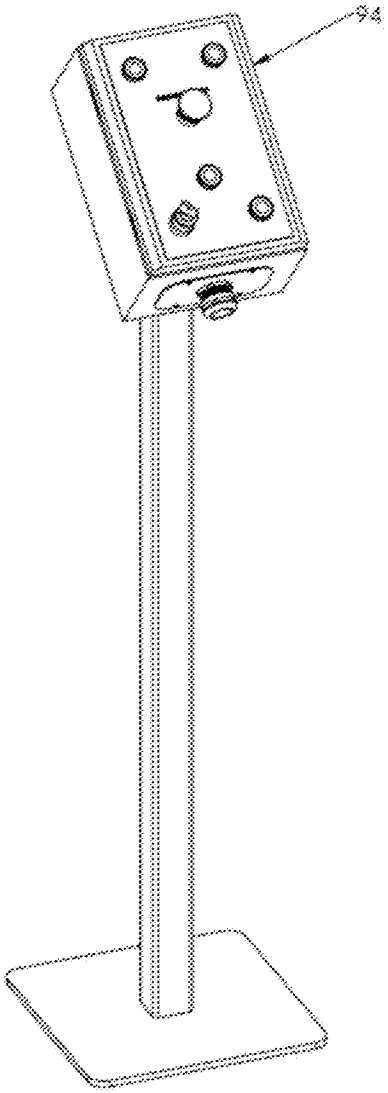

APPARATUS AND METHOD FOR CUTTING A TIRE INTO STRIPS, CUTTING TIRE STRIPS INTO CHIPS, AND STRIPPING A TIRE BEAD

BACKGROUND

Rubber tires may be cut and chopped for various reasons. Cut tires reduce volume during shipment. Cut tires may be chopped into chips and recycled as tire-derived fuel, tire-derived aggregate, playground surfaces, athletic fields, landscaping mulch or a variety of other applications.

Tires often have rubber and steel components. It is desirable for processing machines to separate rubber from steel in scrap tires so the steel and rubber can be separately recycled.

Industrial machines are used to reduce tires into smaller pieces or chips for reuse or recycle. Cutting machines are commonly either rotary shredders comprising pairs of counter-rotating, intermeshing, serrating and shearing blade assemblies or machines that cut tires into strips. Conventional cutting machines include powerful cutters that cut the rubber components of tires. They require the tire to be repositioned relative to the cutters as the tire is cut into sections or strips.

In order for the existing machines or processes to cut a tire into strips, two machines or processes are often required. First, the tire is sliced through its tread in a plane perpendicular to the axis of tire rotation, similar to how one slices a bagel. Once the tire is sliced, each half-tire section is cut into strips starting from the cut through the tread to the bead wire. In the cutting process, the tire may be manually adjusted relative to the cutters to control the cutting process. Manual manipulation of the tire in close contact to cutters can be dangerous due to the moving cutting blades or machinery, which can lead to cutting or crushing of limbs. Further, manually lifting and adjusting the tire is labor intensive and inefficient.

It will be appreciated that there is a need in the art for an apparatus for cutting a tire into strips with less manual labor and that can quickly and efficiently process tires in a safer and less labor intensive manner. It will further be appreciated that there is a need in the art for a bead stripper that also requires minimal manual interaction that can separate rubber from steel in tires quickly and efficiently.

The subject matter claimed herein is not limited to embodiments that solve any disadvantages or that operate only in environments such as those described above. Rather, this background is only provided to illustrate one example technology area where some implementations described herein may be practiced.

SUMMARY OF THE INVENTION

The present disclosure relates generally to a tire cutting apparatus that cuts a whole tire into strips. Tire strips may be further chopped into chips. In some embodiments, a tire may include a first bead wire, a first sidewall, a tread, a second sidewall, and a second bead wire. As used herein, the term "tire" includes all sizes of air-filled tires, including convention automobile and truck tires. The term "tire" also includes much larger tires, including those used with large construction, agricultural and mining equipment. An apparatus for cutting a tire into strips may include a cutting device having a first rotary blade and a second rotary blade. The tire may be positioned between the first rotary blade and the second rotary blade to cut the tire into one or more strips. In some embodiments, the apparatus may further include a positioning system operable to orient the tire between a plurality of lower vertical, horizontal, upper vertical, and intermediate positions, relative to the cutting device.

The apparatus may include one or more support rollers. The one or more support rollers may include a concave surface. The one or more support rollers may position the tire relative to the cutting device and control the cutting width of the strips. In some embodiments, the apparatus may further include a control system. When the apparatus is in operation, the control system may control the operation of the cutting device and positioning system to reposition the tire relative to the cutting device as the tire is cut into strips by the cutting device. The blades of the cutting device may be configured to rotate to cut the tire and the tire may be configured to rotate between the blades.

The positioning system may include a first support configured to lift the tire to a first cutting position. The first support may include a tower. A proximal end of the tower may be coupled to the apparatus and a distal end of the tower may include the first rotary blade of the cutting device. The positioning system may include a second support configured to lift the tire from a first cutting position to a second cutting position.

The second support may include a plurality of rollers. In some embodiments, the tire may rest on the plurality of rollers when the tire is in the second cutting position. The positioning system may include a third support configured to lift the tire from the second cutting position to a third cutting position. The third support may include a plurality of adjustable rollers configured to couple to the second bead wire of the tire. The plurality of rollers may be individually controlled such that the position of an individual roller may be independently adjustable. The third support may include a bead support plate. The bead support plate may slideably adjust to control cutting of the second sidewall without cutting the second bead wire of the tire.

In some embodiments, the cutting device may continuously cut the tire into strips as the positioning system moves the tire between the plurality of lower vertical, horizontal, upper vertical and intermediate positions.

In some embodiments, the cutting device may move between a plurality of lower vertical, horizontal, upper vertical, and intermediate positions relative to the tire, and the tire may be configured to rotate between the blades.

In some embodiments, the cutting device may move between a plurality of horizontal, vertical, and intermediate positions relative to the tire, and the tire may be configured to rotate between the blades.

In some embodiments, the tire may be static and the cutting device rotate and move between the plurality of lower vertical, horizontal, upper vertical, and intermediate positions relative to the tire.

The one or more support rollers may be configured to maintain a position of the tire relative to the cutting device such that the tire is cut into one or more strips having a relatively consistent width. The one or more support rollers may support the full weight of the tire and provide balance to the tire as the cutting device cuts the tire. The location of the support roller relative to the cutting device may be adjustable to accommodate different tire sizes.

In some embodiments, the apparatus for cutting a tire into strips may include a chipper coupled to the apparatus. The chipper may include a rotary blade and receives the one or more strips of the tire from the cutting device and further cuts the one or more strips into pieces. The chipper may include a variable speed drive motor.

In some embodiments, the apparatus for cutting a tire into strips may further include a bead stripper. The bead stripper may include a roller system. The roller system may include two drive rollers and two tension rollers. The roller system rotates a bead wire of a tire. The bead stripper may include a tension arm, having a first end and a second end. The first end may include a third tension roller and the second end may include a pivot. The tension arm may pivot to provide tension to the bead wire. The bead stripper may include a first knife and a second knife positioned to contact the bead wire such that the first knife and the second knife separate the bead wire from an exterior rubber sheath.

In some embodiments, the apparatus for cutting a tire into strips may be configured to couple to a chipper and a bead stripper. The apparatus for cutting a tire into strips may be configured to further couple to a conveyor.

A method for cutting a whole tire into strips may include orienting the tire in a first cutting position. In some embodiments, the tire may be positioned on one or more support rollers where the tire engages a cutting device including a blade and a drive roller. The first cutting position may include the tire being oriented such that the blade may be positioned between the first bead wire and the first sidewall. The method for cutting a tire into strips may include removing the first bead wire from the tire and cutting a first sidewall of the tire into a first sidewall strip. While the tire continuously engages the cutting device, the method may further include orienting the tire in a second cutting position and cutting the tread of the tire into a tread strip. While the tire continuously engages the cutting device, the method may include orienting the tire in a third cutting position. The method may include cutting the second sidewall of the tire into a second sidewall strip until only the second bead wire remains and disengaging the cutting device from the remaining second bead wire.

In some embodiments, the first cutting position orients the first sidewall between the blade and drive roller, the second cutting position orients the tread between the blade and drive roller, and the third cutting position orients the second sidewall between the blade and drive roller. The first cutting position may orient the tire between about −110° to about −80° to the ground, the second cutting position may orient the tire between about −20° to about 20° to the ground, and the third cutting position may orient the tire between about 40° to about 80° to the ground. In some embodiments, the first cutting position may orient the cutting device between the first bead wire and the first sidewall of the tire. The second cutting position may orient the cutting device between the first sidewall and the second sidewall of the tire to cut the tread. The third cutting position may orient the cutting device between the second sidewall of the tire and the second bead wire.

The one or more support rollers may be configured to maintain a position of the tire relative to the cutting device such that the tire is cut into one or more strips having a relatively consistent width as the tire is lifted to the first cutting position, the second cutting position, and the third cutting position. The method for cutting a tire into strips may further include feeding the tire strip directly into a chipper, where the tire strip is further cut into chips.

In some embodiments, the method may include placing one of the first or second bead wire in a bead stripper and separating the bead wire from an exterior rubber sheath. In some embodiments, the bead stripper may include a control system. While in operation, the control system may control the operation of the drive rollers and the first knife and the second knife.

It is to be understood that both the foregoing general description and the following detailed description are exemplary and explanatory and are not restrictive of the invention, as claimed. It should be understood that the various embodiments are not limited to the arrangements and instrumentality shown in the drawings. It should also be understood that the embodiments may be combined, or that other embodiments may be utilized and that structural changes, unless so claimed, may be made without departing from the scope of the various embodiments of the present invention. The following detailed description is, therefore, not to be taken in a limiting sense.

BRIEF DESCRIPTION OF THE DRAWINGS

Example embodiments will be described and explained with additional specificity and detail through the use of the accompanying Figures in which:

FIG. 8A is a perspective view of an example bead stripper, according to some embodiments;

It is to be understood that the Figures are for purposes of illustrating the concepts of the present disclosure and may not be drawn to scale. Furthermore, the Figures illustrate exemplary embodiments and do not represent limitations to the scope of the present disclosure.

DETAILED DESCRIPTION OF THE INVENTION

Exemplary embodiments of the present disclosure will be best understood by reference to the Figures, wherein like parts are designated by like numerals throughout. It will be readily understood that the components of the present disclosure, as generally described and illustrated in the Figures herein, could be arranged and designed in a wide variety of different configurations. Thus, the following more detailed description of the embodiments of the apparatus and systems, as represented in the Figures, is not intended to limit the scope of the present disclosure, as claimed in this or any other application claiming priority to this application, but is merely representative of exemplary embodiments of the present disclosure.

Figure 1A:
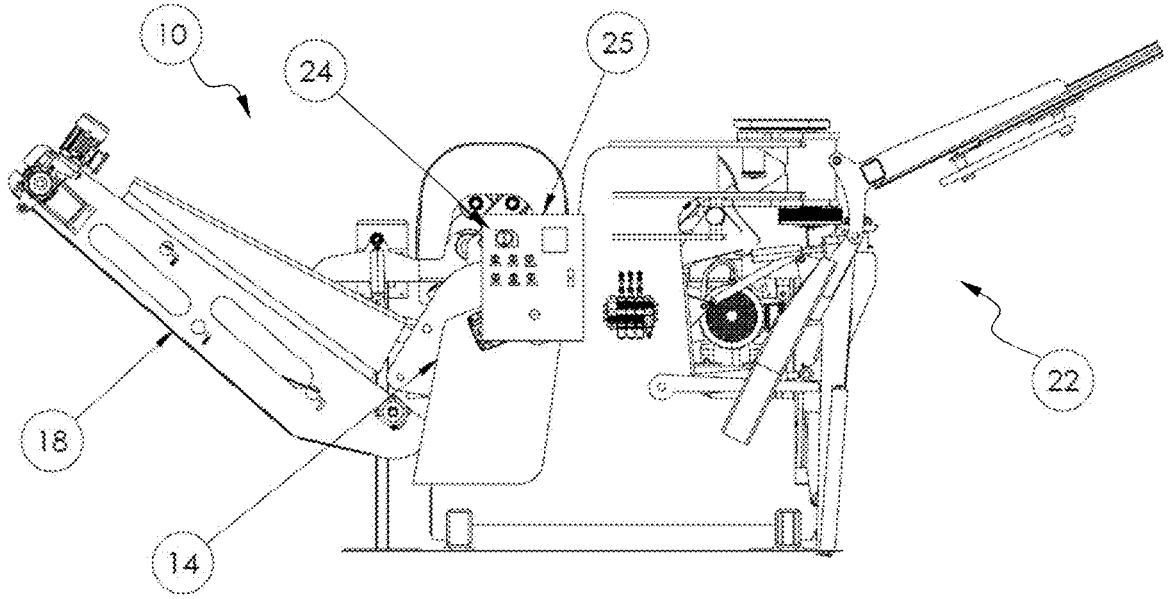
FIG. 1A is a front elevation view of an example tire processing machine, according to some embodiments.
Figure 1B:
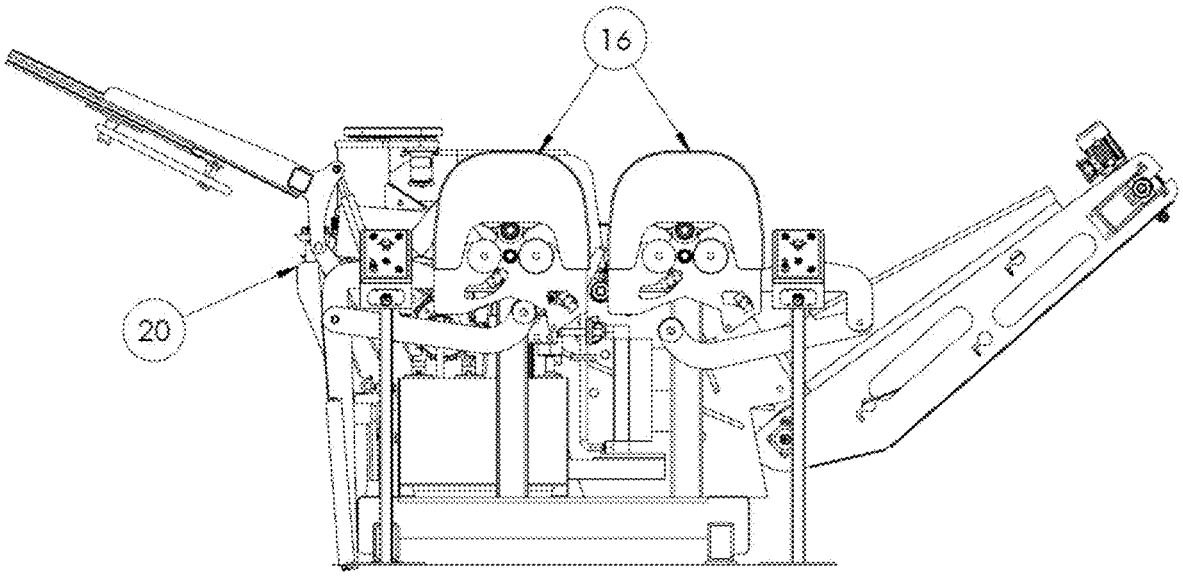
FIG. 1B is a rear elevation view of the tire processing machine shown in FIG. 1A.
Figure 1C:
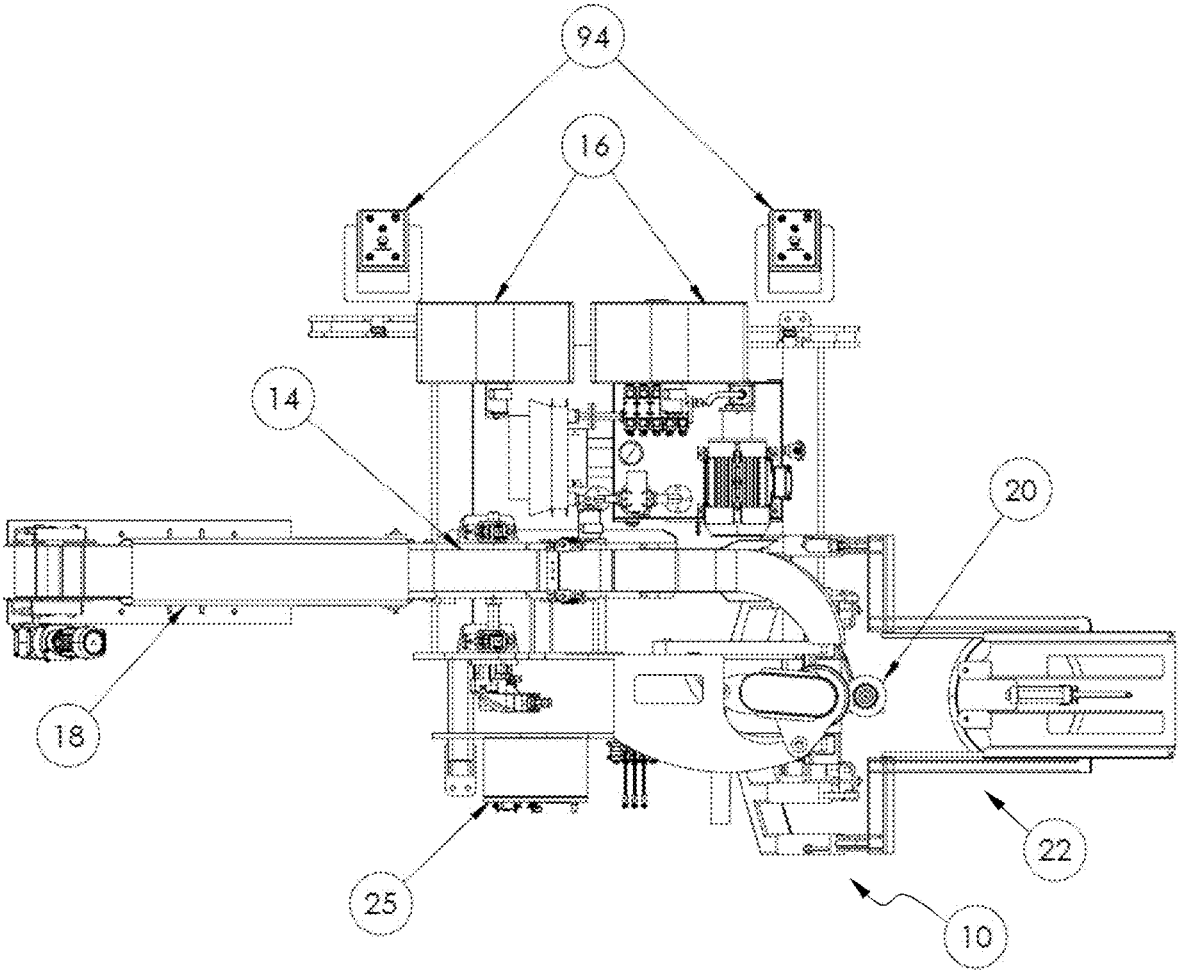
FIG. 1C is a top plan view of the tire processing machine shown in FIG. 1A.

The present disclosure relates generally to an apparatus for cutting a whole tire into strips. Referring now to FIGS. 1A-1C, an apparatus 10 for cutting a tire into strips is shown. The apparatus 10 may be part of a tire processing machine, an example of which is denoted generally at 12. In some embodiments, the tire processing machine 12 may include an apparatus 10 for cutting a tire into strips, a chipper 14, a bead stripper 16, and a conveyor 18. Each component will be explained in greater detail below. The apparatus 10 may include a cutting device 20. The apparatus 10 may include a positioning system 22 that is operable to orient the tire between a plurality of vertical, horizontal, and intermediate positions, relative to the cutting device 20.

The tire processing machine 12 may include a control system 24. The control system may control the operation of the cutting device and positioning system to reposition the tire relative to the cutting device. The control system 24 may be operated from a control panel 25 mounted on the tire processing machine 12. In some embodiments, the control system 24 may be operated from a remote location.

Figure 2A:
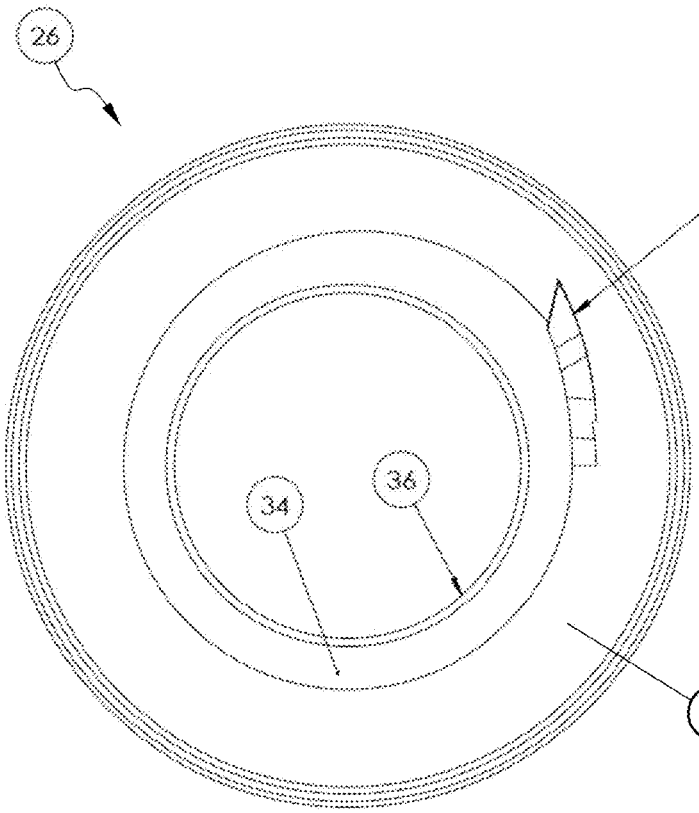
FIG. 2A is a front elevation view of an example tire, according to some embodiments.
Figure 2B:
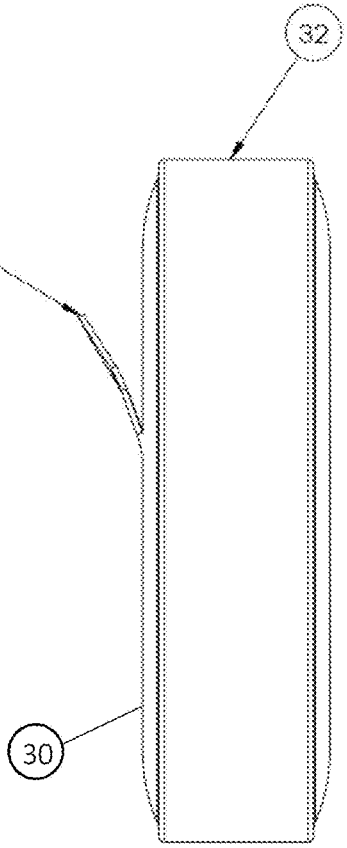
FIG. 2B is a side view of the tire shown in FIG. 2A.

Tires may include components that need to be separated for recycling or further processing. A tire will generally include first and second bead wires. Bead wires couple the tire to a wheel rim. Bead wires may include an interior metallic wire with an outer rubber sheath. The tire will also include first and second sidewalls. The sidewalls extend from the bead wire to an edge of a tire tread. The tread engages and contacts the driving surface in use. Referring now to FIGS. 2A and 2B, an example tire 26 being cut into a strip is shown. In the illustrated tire, a first bead wire has been cut and removed from the tire. A first sidewall 30 is being cut into a strip 31. The first sidewall 30 of the tire connects the bead wire to a tread 32. The tire 26 then includes a second sidewall 34 connected to another side of the tread and also a second bead wire 36. Tires may include other components and may include different diameters and width of treads, but generally the components discussed will be referred to below in explaining the function of the apparatus for cutting the tire into strips 10 and the tire processing machine 12.

Figure 3A:
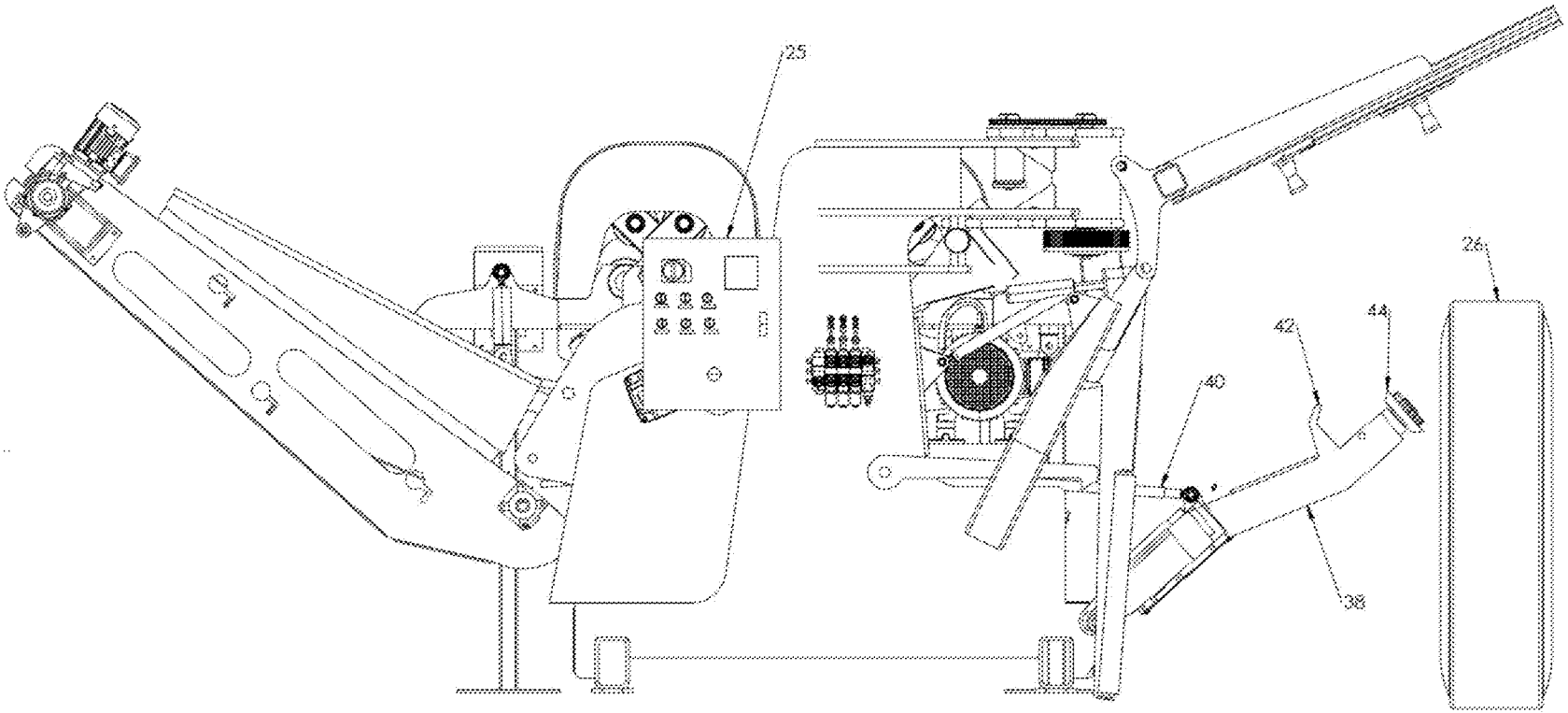
FIG. 3A is a side view of the tire processing machine of FIGS. 1A-1C and an example tire, according to some embodiments.

Referring now to FIG. 3A, an example apparatus 10 for cutting a whole tire into strips is shown. The apparatus 10 includes a first support tower 38. The first support tower 38 includes a tower having a proximal end coupled to the apparatus 10 and a distal end including the blade of the cutting device 20. In some embodiments, the first support tower 38 may be lowered by a first support tower hydraulic system 40 that is operated with the control system 24 and panel 25. The hydraulic system may be operated by a hydraulic control system. The first support tower 38 may be lowered so that the first support tower can lift the tire 26 from the ground to a first cutting position or, in other words, an orientation that will enable the apparatus 10 to cut the tire 26 into strips.

The first support tower 38 may be lowered to a position that the tire 26 may be placed onto the first support tower 38 with minimal or no lifting of the tire from the ground. After the tire is placed on the first support tower 38, the first support tower 38 may be raised to a position that is generally perpendicular to the ground and the tire 26 is elevated such that the full weight of the tire 26 is on the first support tower 38.

In some embodiments, the first support tower 38 includes a first support tower hook 42 extending from the support tower. More than one first support tower hook 42 may be included. The first support tower hook 42 may extend from the first support tower in a direction towards the apparatus 10 for cutting a tire into strips. The first support tower hook 42 may prevent the tire 26 from slipping or moving down the first support tower 38 as the tire 26 is lifted off of the ground. In some embodiments, the first support tower hook 42 catches the first bead wire 28 after it has been cut from the tire.

The tire 26 may be manually positioned onto the distal end of the first support tower 38. In some embodiments, the tire 26 is positioned such that a first rotary blade 44 of the cutting device 20 is contacting an interior side of the first sidewall 30 of the tire 26. The apparatus 10 may be used on a variety of different sized tires. In some embodiments, the apparatus 10 includes spatially adjustable components to accommodate tires having various diameters or those that are sized for any vehicle, including but not limited to automobile tires, truck tires, construction equipment tires, agricultural equipment tires, mining equipment tires, and so forth.

Figure 3B:
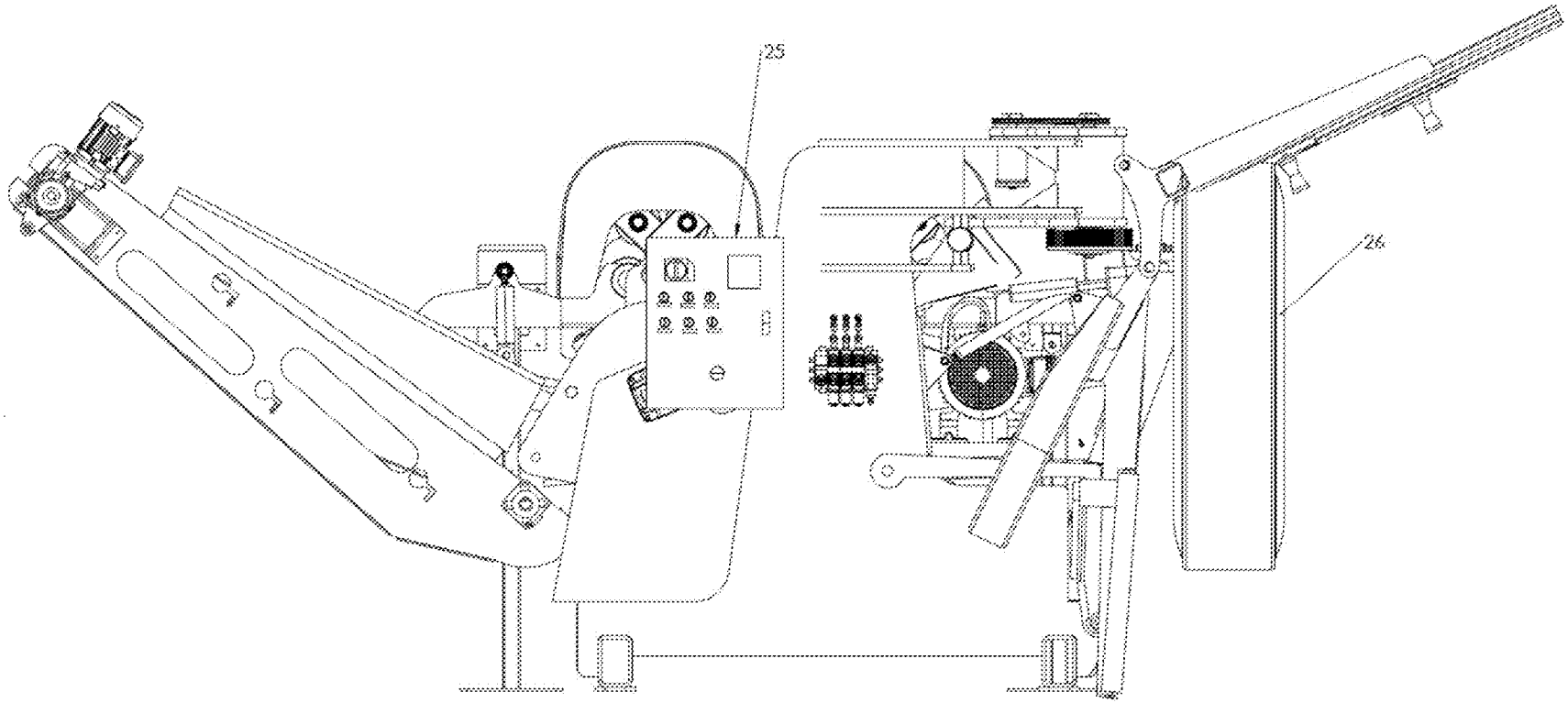
FIG. 3B is a front view of an example apparatus for cutting a tire into strips with a tire in a first cutting position, according to some embodiments.
Figure 3C:
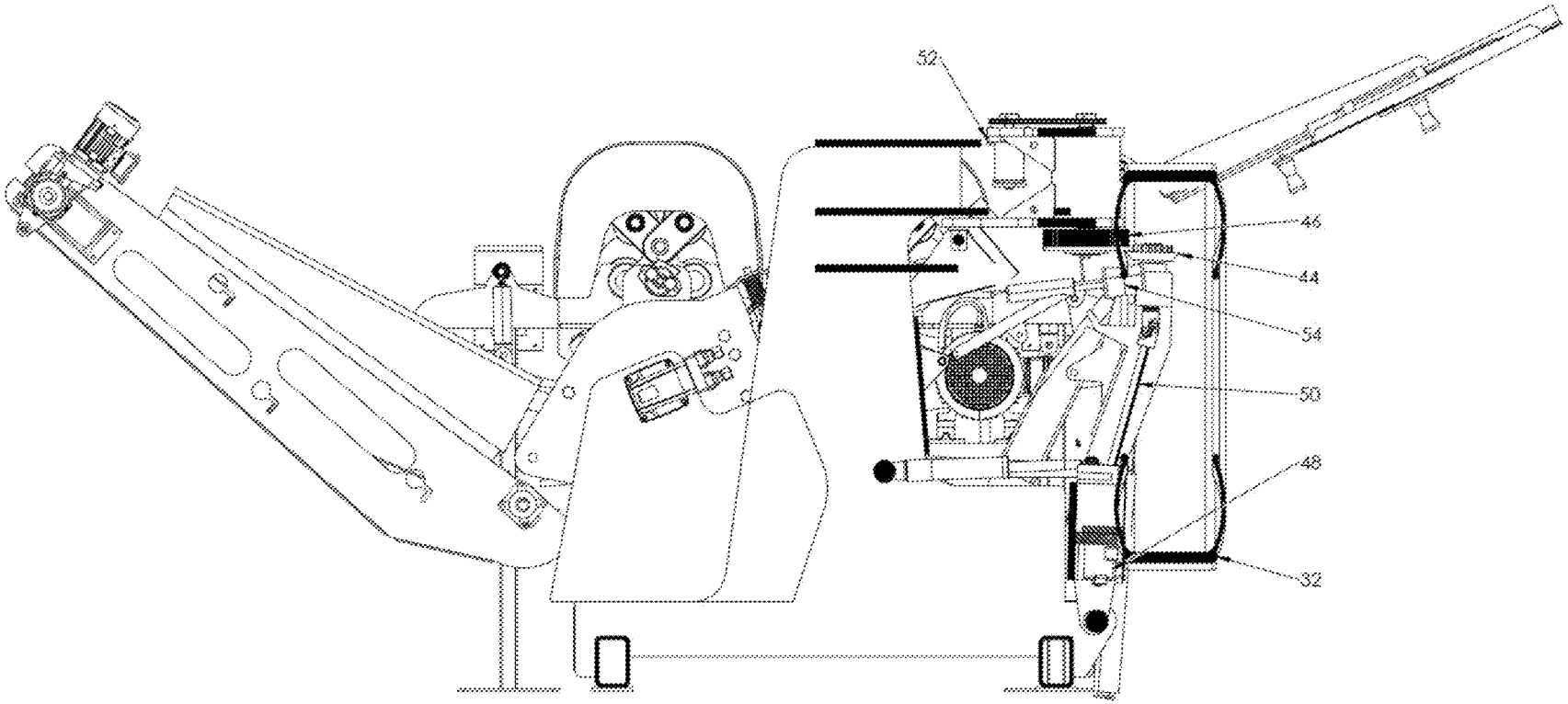
FIG. 3C is a partial cross-sectional view of the example apparatus for cutting a tire into strips with an example tire in a first cutting position, according to some embodiments.

Referring now to FIGS. 3B and 3C, the tire 26 may be lifted by the first support tower 38. The first support tower 38 may lift the tire 26 and may orient the tire to the first cutting position. The tire 26 may be placed in the first cutting position in which the tire is oriented such that the first sidewall 30 is positioned between the first rotary blade 44 and the second rotary blade 46 of the cutting device 20.

The first rotary blade 44 and the second rotary blade 46 may be circular or cylindrical. The first rotary blade 44 and/or the second rotary blade 46 may rotate at a variety of speeds as controlled by the control system 24. The first rotary blade 44 may be coupled to a first blade motor 48 that causes the first rotary blade 44 to rotate. The first blade motor 48 may be located near the base of the first support tower 38 such that it is convenient to access for maintenance. The first rotary blade 44 and the first blade motor 48 may be coupled with a first blade motor drive shaft 50. The first blade motor drive shaft may include at least one extension shaft and/or universal joint. The first blade motor 48 may be located near the proximal end of the first support tower 38. The first blade motor 48 may be an electric motor. The first blade motor 48 may be a variable speed induction motor. The first blade motor 48 may be a hydraulic motor. In some embodiments, the first blade motor 48 may be electrically coupled to the control system 24 and control panel 25.

The second rotary blade 46 may be coupled to a second blade motor 52. The second blade motor 52 may be located above the second rotary blade 46. The second blade motor 52 may be directly coupled to the second rotary blade 46.

The second blade motor 52 may be an electric motor. The second blade motor 52 may be an AC or DC synchronous motor. The second blade motor 52 may be an induction motor. The second blade motor 52 may be a hydraulic motor.

In some embodiments, as the tire 26 is oriented to a first cutting position, the first sidewall 30 of the tire 26 may be positioned between the first rotary blade 44 and the second rotary blade 46. The first cutting position may be defined as the tire being oriented between about −110° to about −80° to the ground. As the first rotary blade 44 and the second rotary blade 46 rotate to cut the tire, the first bead wire 28 may be cut from the tire. The first bead wire 28 may be completely removed from the tire. In some embodiments, after being removed from the tire 26, the first bead wire 28 falls onto the first support tower hook 42 and is held by the first support tower hook 42.

When the tire 26 is in the first cutting position, the tire may be in contact with one or more support rollers 54. In some embodiments, the support roller 54 includes a concave surface. The support roller 54 may support or position the tire relative to the cutting device 20 as the tire 26 moves between the plurality of vertical, horizontal, and intermediate positions. The one or more support rollers 54 support the weight of the tire 26 such that the tire rests on the support rollers 54 as it rotates between the first rotary blade 44 and the second rotary blade 46.

In some embodiments, the concave surface of the support roller 54 is such that the strip of tire between the support roller 54 and the cutting device 20 has a generally constant width. The width of the strip of tire may vary depending on the desired end use. The concave surface of the support roller 54 may be configured such that gravity and the weight of the tire cause the tire to slide toward the inflection point of the support roller 54. Thus, the positioning of the tire 26 on the support roller 54 causes the first rotary blade 44 to cut the first sidewall 30 of the tire 26 in a spiral strip having a relatively constant width. In some embodiments, the location of the support roller 54 relative to the cutting device 20 may be adjustable to accommodate different size tires. The location of the one or more support rollers 54 may be adjusted manually or may be adjusted with the control system 24.

Figure 4:
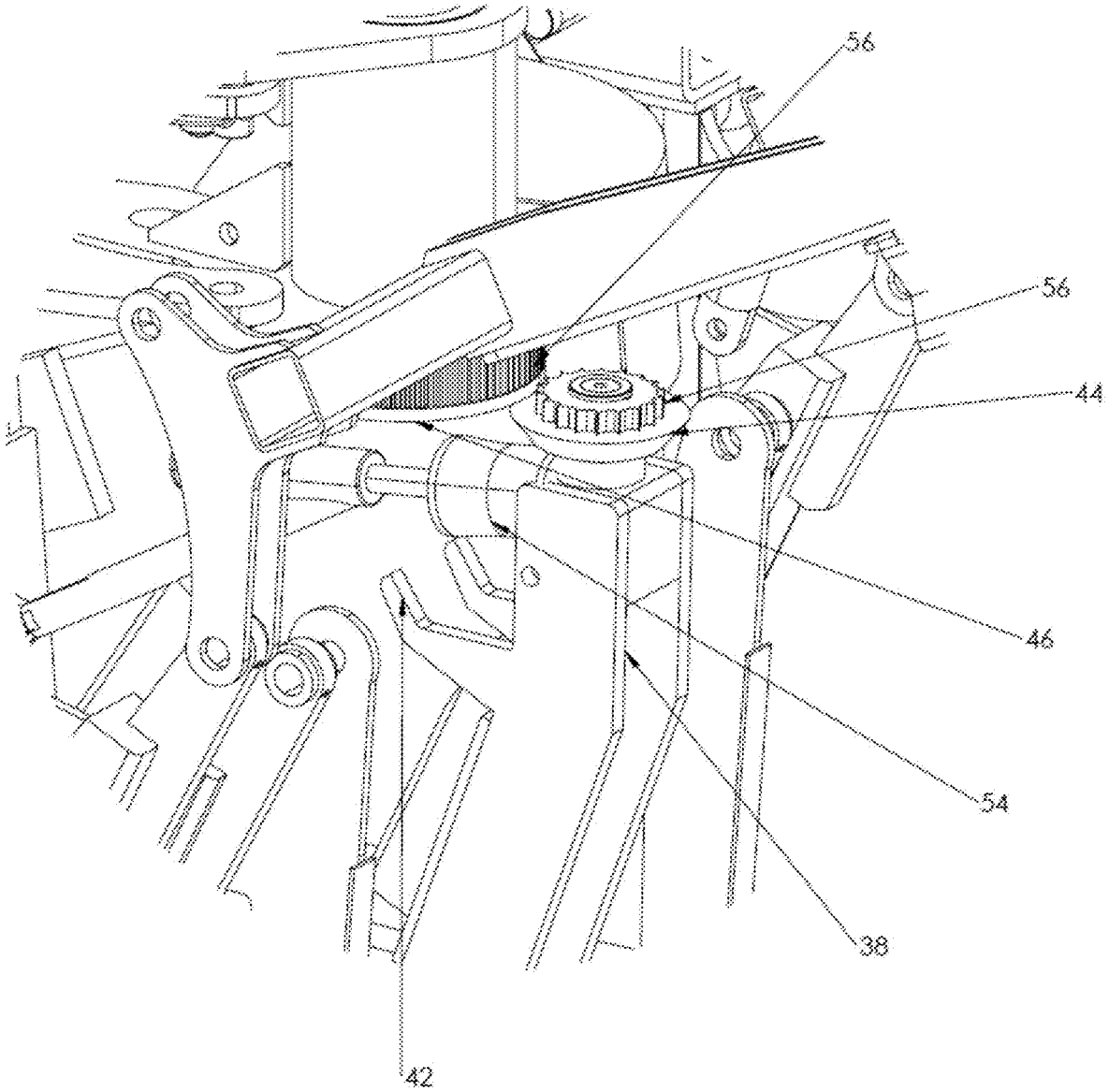
FIG. 4 is a perspective view of an example cutting device, according to some embodiments.

Referring now to FIG. 4, the first rotary blade 44 may be a circular metallic or ceramic blade mounted on a rotating shaft coupled to the first support tower 38. In some embodiments, the cutting device includes textured surfaces 56 that contact and grip the tire 26 and grips the tire as it rotates between the first rotary blade 44 and the second rotary blade 46. The first rotary blade 44 may extend underneath the second rotary blade 46 and ensure that any portion of the tire 26 is cut through. The first rotary blade 44 of the cutting device may be configured to rotate to cut the tire 26 and the second rotary blade 46 is configured to rotate the tire 26 against the first rotary blade 44. In some embodiments, the cutting device continuously cuts the tire 26 into strips as the positioning system 22 moves the tire between the plurality of vertical, horizontal, and intermediate positions.

Figure 9:
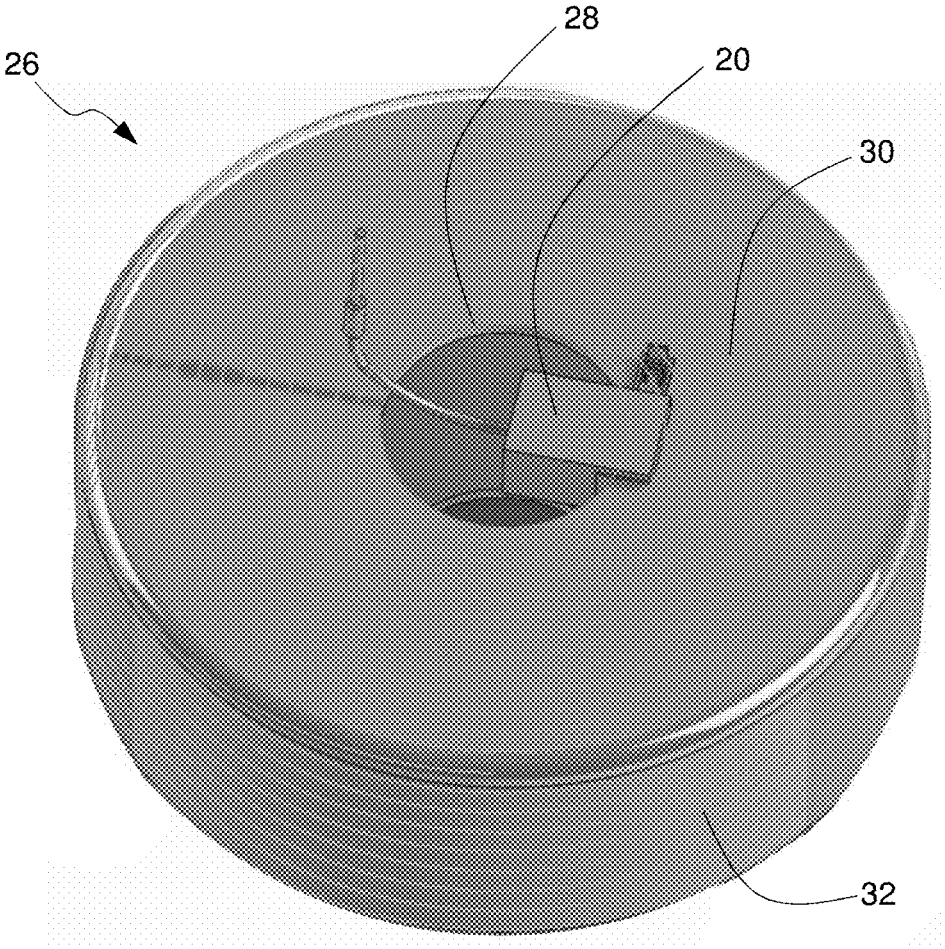
FIG. 9 is a perspective view of a tire and a cutting device showing a position of the cutting device relative to the tire and a cutting pattern followed by the cutting device as it moves cutting the tire into strips.

The cutting device 20 may be repositionable. The cutting device 20 may move between the plurality of lower, intermediate, and upper positions relative to the tire 26. In some embodiments, the tire 26 may be static and the cutting device 20 moves between the plurality of lower, intermediate, and upper positions to cut the tire 26. The tire may also rotate as the cutting device moves between the plurality of positions to cut the tire 26. FIG. 9 shows a tire 26 and a cutting device 20. The cutting device 20 is configured to move relative to the tire 26. An initial position of the cutting device relative to the tire is shown. FIG. 9 also shows a cutting pattern for cutting the tire into strips. The cutting device 20 contains two rotating blades which hydraulically clamp together to cut the tire into strips. Textured rollers are provided to slowly move and support the cutting device relative to the tire and to enable the cutting device to track a cutting pattern around the tire sidewalls and tread during the cutting process. The cutting device 20 is shown engaged to the tire 26 adjacent the first bead wire 28. In operation, the cutting device first cuts around the first bead wire 28 to separate it from the tire. The cutting device then moves and cuts inside the edge where the bead wire was removed. The cutting device 20 moves in a helical motion and cuts a strip from the first sidewall 30. The cutting device continues moving to cut the tread 32 and the second sidewall, leaving only the second bead wire. The cutting device shown in FIG. 9 is particularly suitable for very large tires, including tires too large for the apparatus for cutting a whole tire into strips described above.

Figure 5:
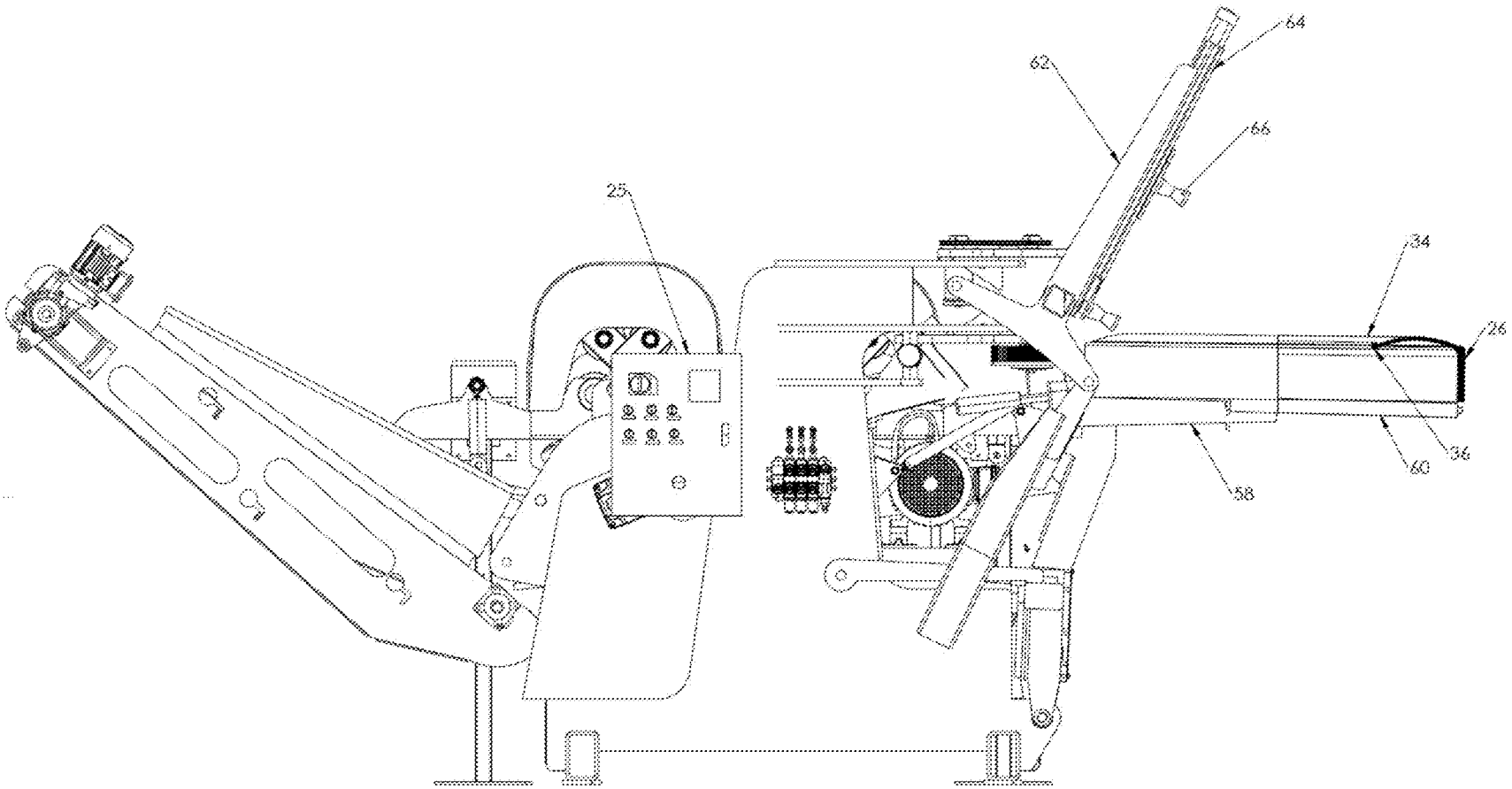
FIG. 5 is a side view of the example apparatus for cutting a tire into strips with an example tire, shown in partial cross-section, in a second cutting position, according to some embodiments.

Referring now to FIG. 5, the positioning system 22 may include a second support 58. The second support 58 may be configured to lift the tire from a first cutting position to a second cutting position. The second support 58 may include one or more towers having a proximal end coupled to the apparatus 10 and further include one or more second support rollers 60 that support the tire 26. The second support 58 may include support rollers 60 so that the tire 26 may rotate with minimal friction as the cutting device 20 rotates. In some embodiments, while the tire 26 is not oriented in the second cutting position, the second support 58 may be positioned between about −110° to about −80° to the ground.

The second support 58 may be configured to pivot to lift the tire 26 as it is being cut by the cutting device 20 to orient the tire between about −20° to about 20° to the ground. In some embodiments, the tire 26 is oriented such that the cutting device 20 cuts the tread 32. The second support 58 may be operated by the control panel 25. The second support 58 may automatically reposition the tire 26 from a first cutting position to a second cutting position, such that the tire 26 continues to be cut into a continuous strip. The second support rollers 60 may be individually controlled such that the position of an individual roller is independently adjustable. The rollers may be controlled to operate in a bank or individually to aid the cutting device 20 in cutting the tire 26 into a strip. The tire 26 may be in the second cutting position as the entirety of the tread 32 is cut into strips.

Figure 6A:
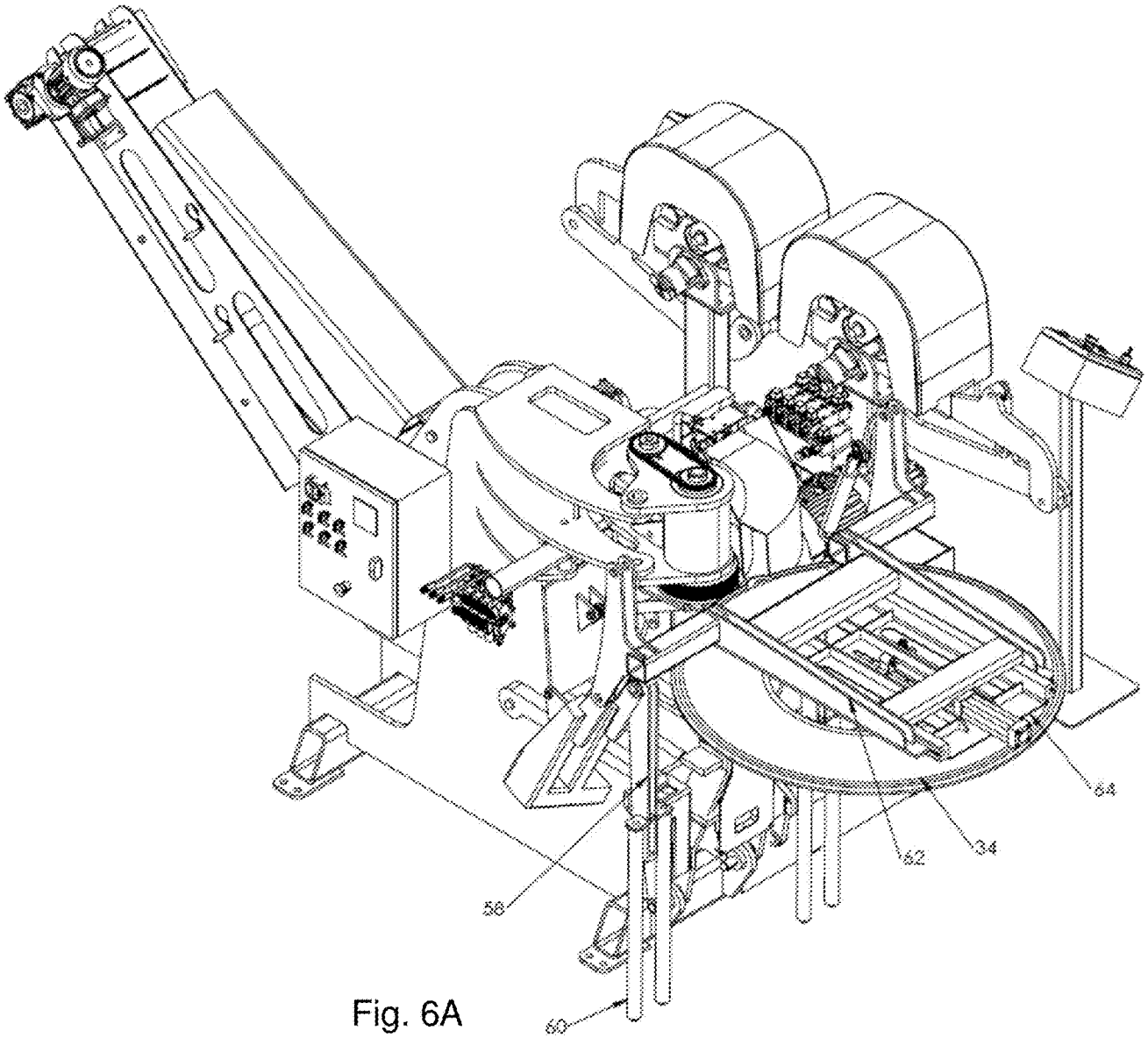
FIG. 6A is a perspective view of the example apparatus for cutting a tire into strips, according to some embodiments.
Figure 6B:
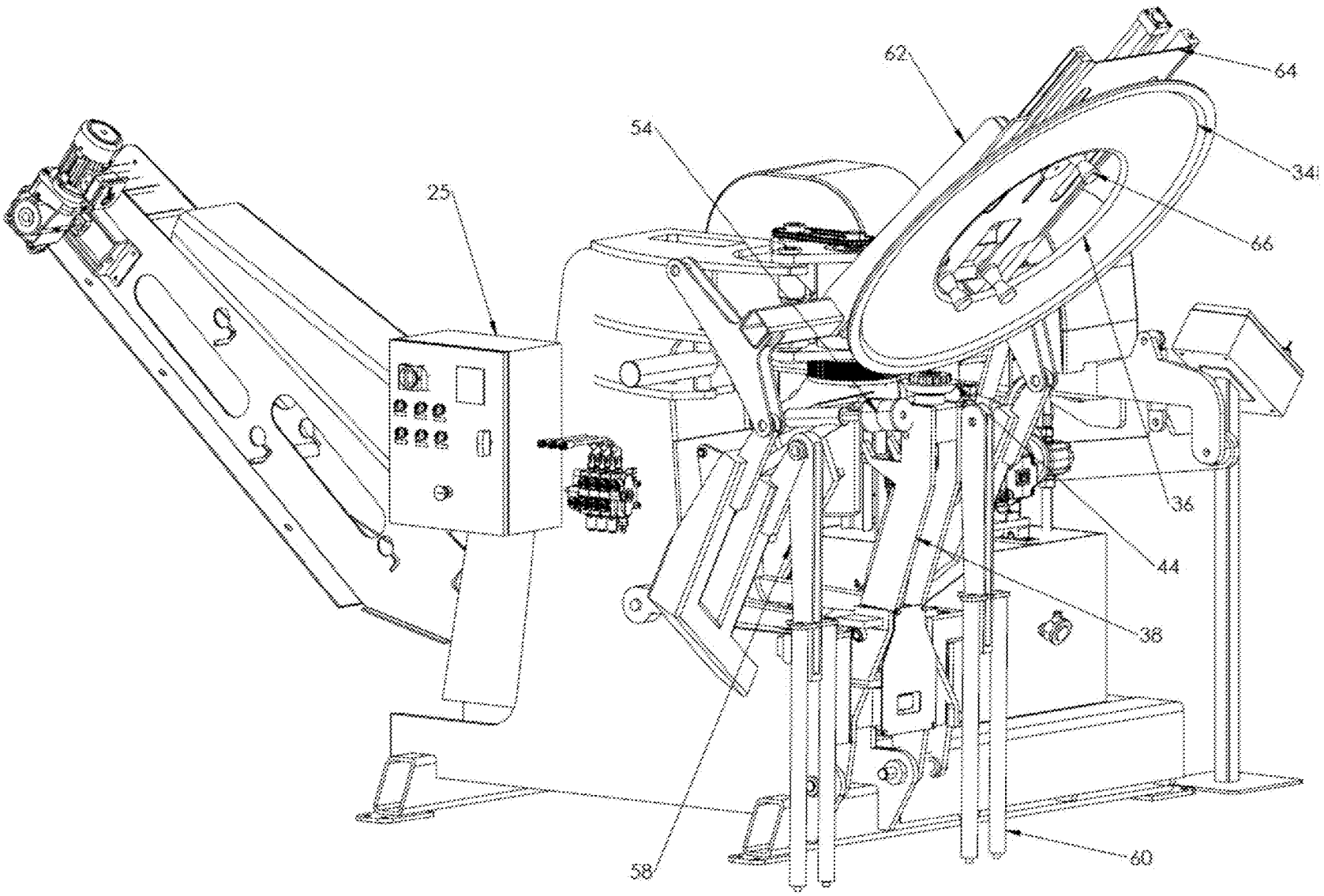
FIG. 6B is a perspective view of the example apparatus for cutting a tire into strips with an example tire in a third cutting position, according to some embodiments.
Figure 6C:
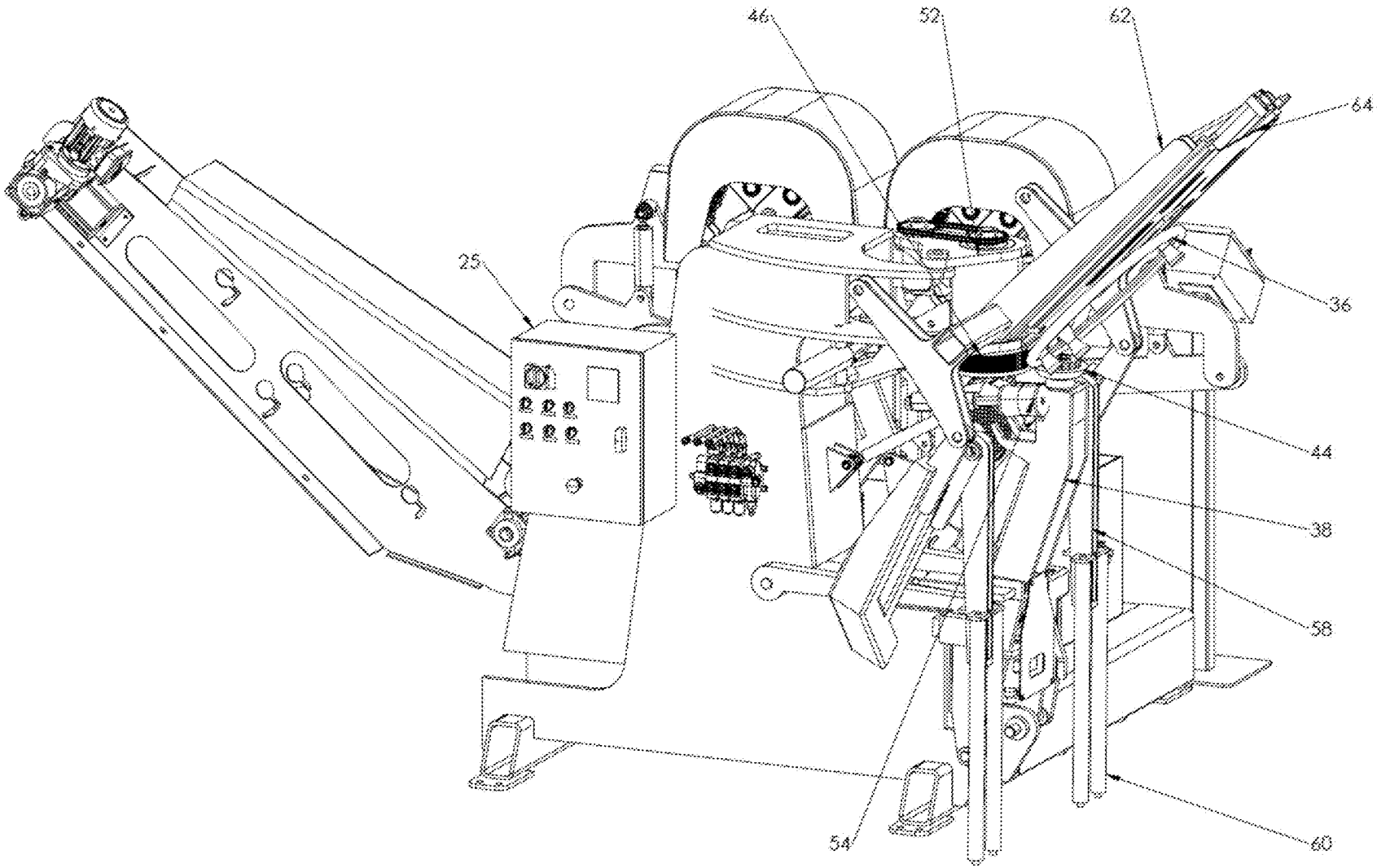
FIG. 6C is another perspective view of the example apparatus for cutting a tire into strips with an example tire in a third cutting position, according to some embodiments.

Referring now to FIGS. 6A-6C, The positioning system 22 may include a third support 62. In some embodiments, the third support 62 may be configured to lift the tire from the second cutting position to a third cutting position. The third cutting position may be defined as the tire 26 being oriented between about 40° to about 80° relative to the ground.

In some embodiments, the third support 62 includes a plurality of adjustable third support rollers 66. The third support rollers 66 may be configured to couple to the second bead wire 36 of the tire 26. The third support rollers 66 couple to the second bead wire 36 and are configured such that the tire 26 rotates as the cutting device 20 cuts it into strips. The third support rollers 66 may be individually controlled such that the position of an individual roller is independently adjustable.

The third support 62 may include a bead support plate 68. In some embodiments, the bead support plate 68 slideably adjusts. The bead support plate may adjust to move the tire 26 laterally towards the cutting device 20 as the tire is cut into strips. In some embodiments, the bead support plate 68 adjusts to couple the third support rollers 66 to the second bead wire 36.

The tire may be in the third cutting position as the cutting device 20 cuts the tread 32 and the second sidewall 34. In some embodiments, the adjustable bead support plate 68 is controlled automatically by the control system 24. The second sidewall 34 of the tire may be cut into strips until the cutting device approaches the second bead wire 36. The cutting device 20 may then stop cutting the tire 26 as the cutting device 20 reaches the second bead wire 36 and the second bead wire remains on the third support rollers 66.

A method of operating the apparatus for cutting a tire into strips may include having the tire 26 in a first cutting position. In some embodiments, the first cutting position includes the tire raised from the ground and positioned on the one or more support rollers 54. The first cutting position may further include the tire engaging the cutting device 20 in an orientation such that the first rotary blade 44 of the cutting device is inside the tire and the second rotary blade 46 of the cutting device is outside the tire. The first rotary blade 44 may be positioned between the first bead wire 28 and the first sidewall 30.

In some embodiments, the tire 26 may be lifted to the first cutting position by a hydraulic system. The first rotary blade motor 48 and the second rotary blade motor 52 may then be started and the tire rotates as the rotary blades cut through the first sidewall 30. The tire may be positioned such that the first bead wire is removed from the tire and falls to the first support tower hook 42. The one or more support rollers 54 may support the tire as it rotates, the second rotary blade and the first rotary blade may also be rotating to cut the first sidewall 30 into a strip.

In some embodiments, the tire 26 remains engaged to the cutting device 20 and the cutting device continues to cut the tire into a strip as the positioning system 22 and the second support 58 lifts the tire to the second cutting position. While being lifted and while in the second cutting position, the cutting device cuts the tread of the tire into a strip. The tire may remain engaged to the cutting device while the positioning system 22 lifts the tire to the third cutting position. The cutting device may continue to cut, then cutting the second sidewall 34 of the tire into a second sidewall strip until only the second bead wire 36 remains. The cutting device may then be disengaged from the tire 26 and the second bead wire remains coupled to the third support plate 64. In some embodiments, the second bead wire 36 may be manually removed from the third support rollers 66. The second bead wire may fall off the third support rollers as the bead support plate 68 adjusts to the initial position as controlled by the control system 24 and control panel 25.

The tire may be stationary as cutting device 20 repositions between the first cutting position, the second cutting position, and the third cutting position. As the cutting device 20 repositions, other intermediate cutting positions may be necessary or preferred to configure the cutting device position relative to the tire. The cutting device 20 may move between the plurality of lower vertical, horizontal, upper vertical, and intermediate positions relative to the tire 26. In some embodiments, the tire 26 may be static and held in a first cutting position while the cutting device 20 moves and/or repositions between the plurality of lower vertical, horizontal, upper vertical, and intermediate positions to cut the tire 26. The tire may also be rotated as the cutting device moves between the plurality of positions to cut the tire 26.

Figure 7:
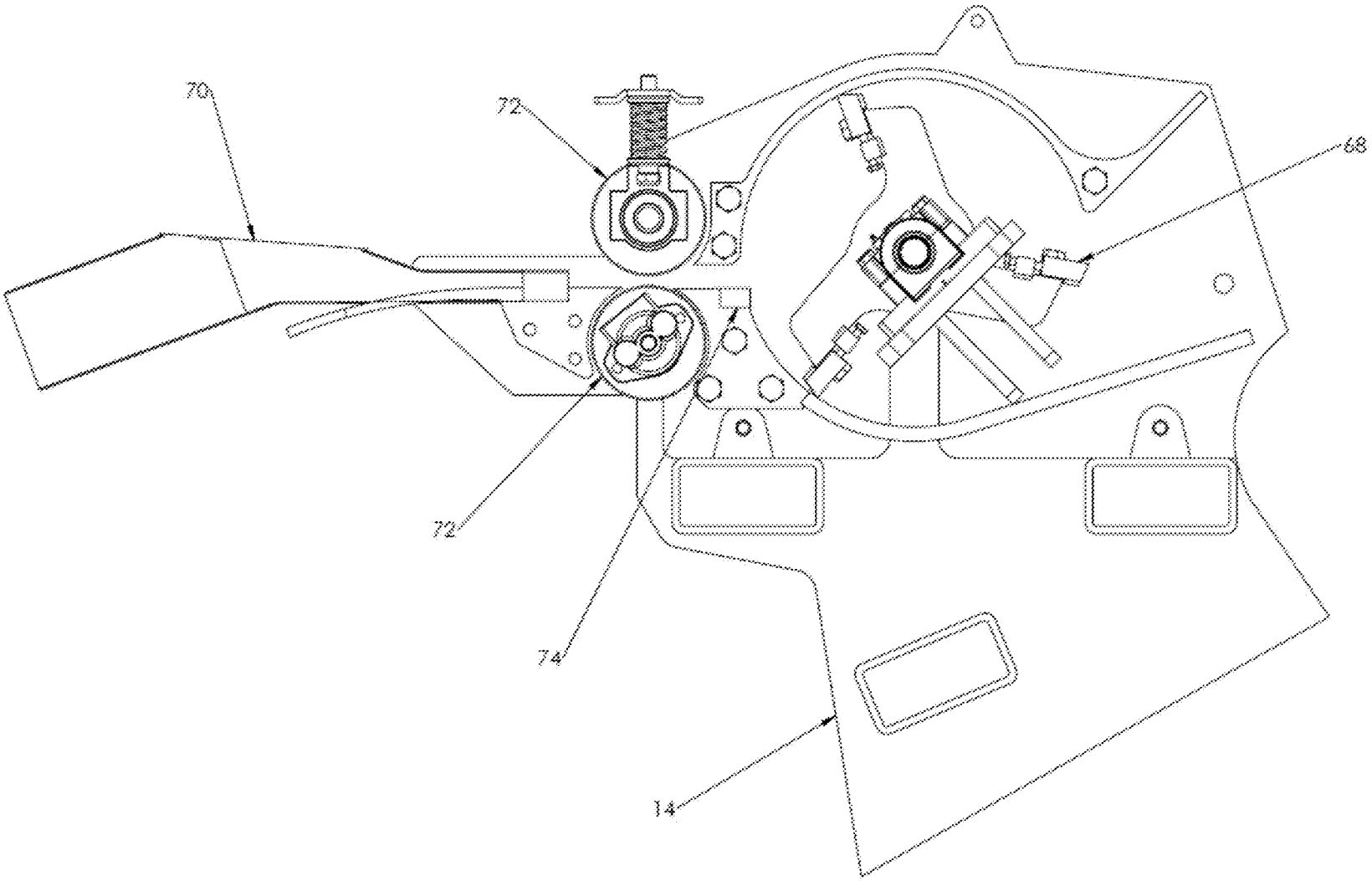
FIG. 7 is a cross-sectional view of an example chipper, according to some embodiments.
Figure 8B:
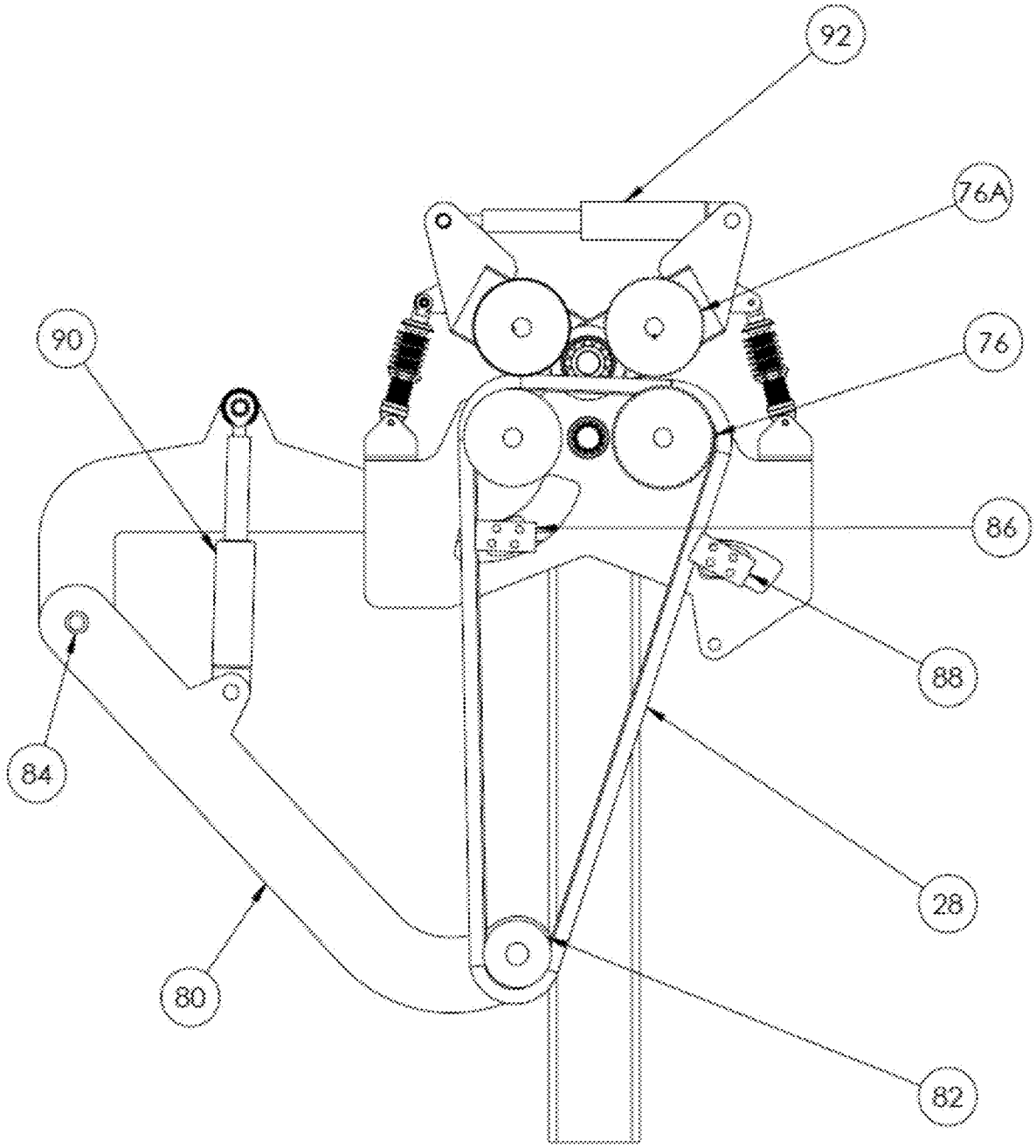
FIG. 8B is a partial side view of the example bead stripper of FIG. 8A, according to some embodiments.
Figure 8C:
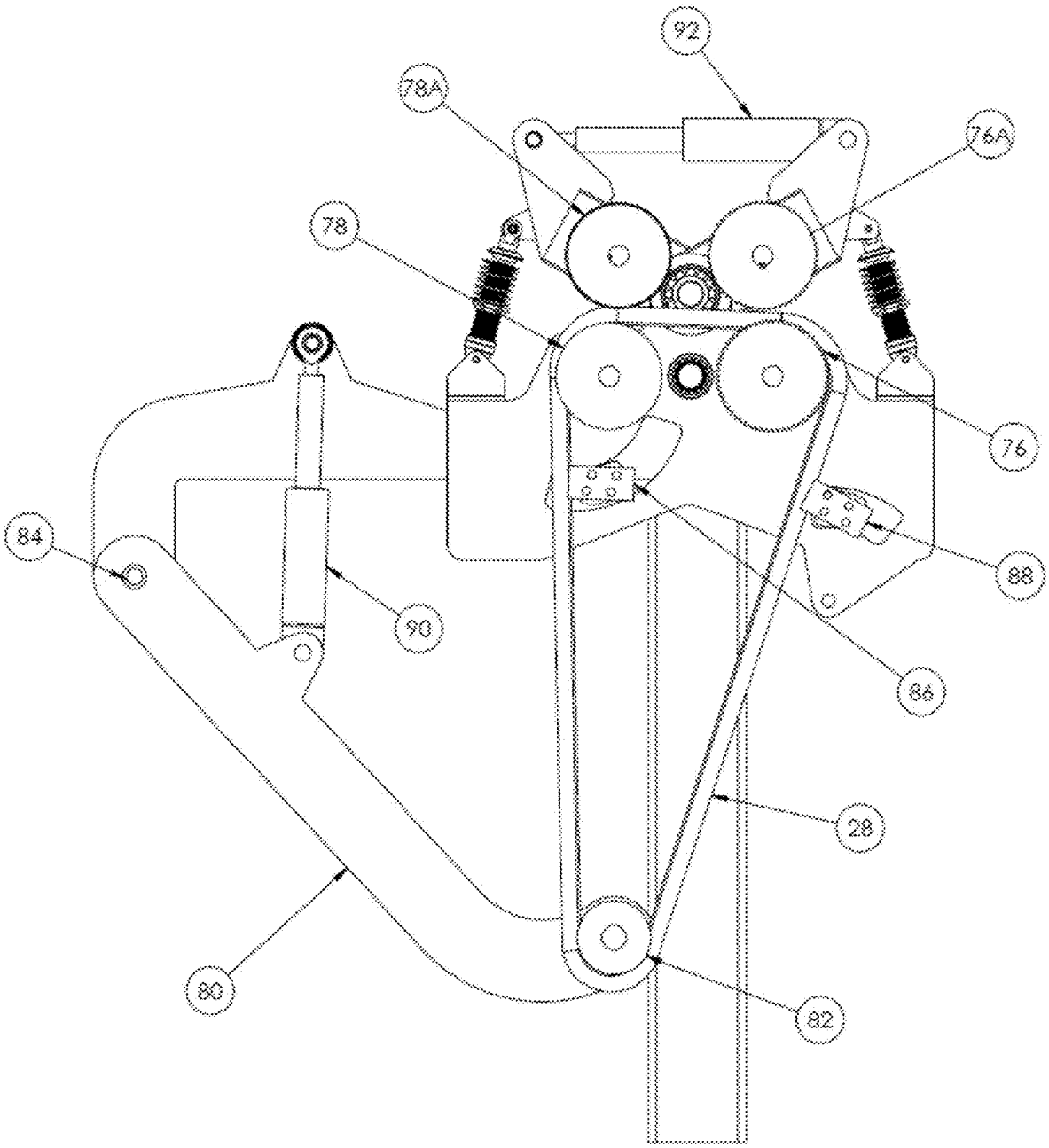
FIG. 8C is another partial side view of an example bead stripper according to some embodiments.
Figure 8D:
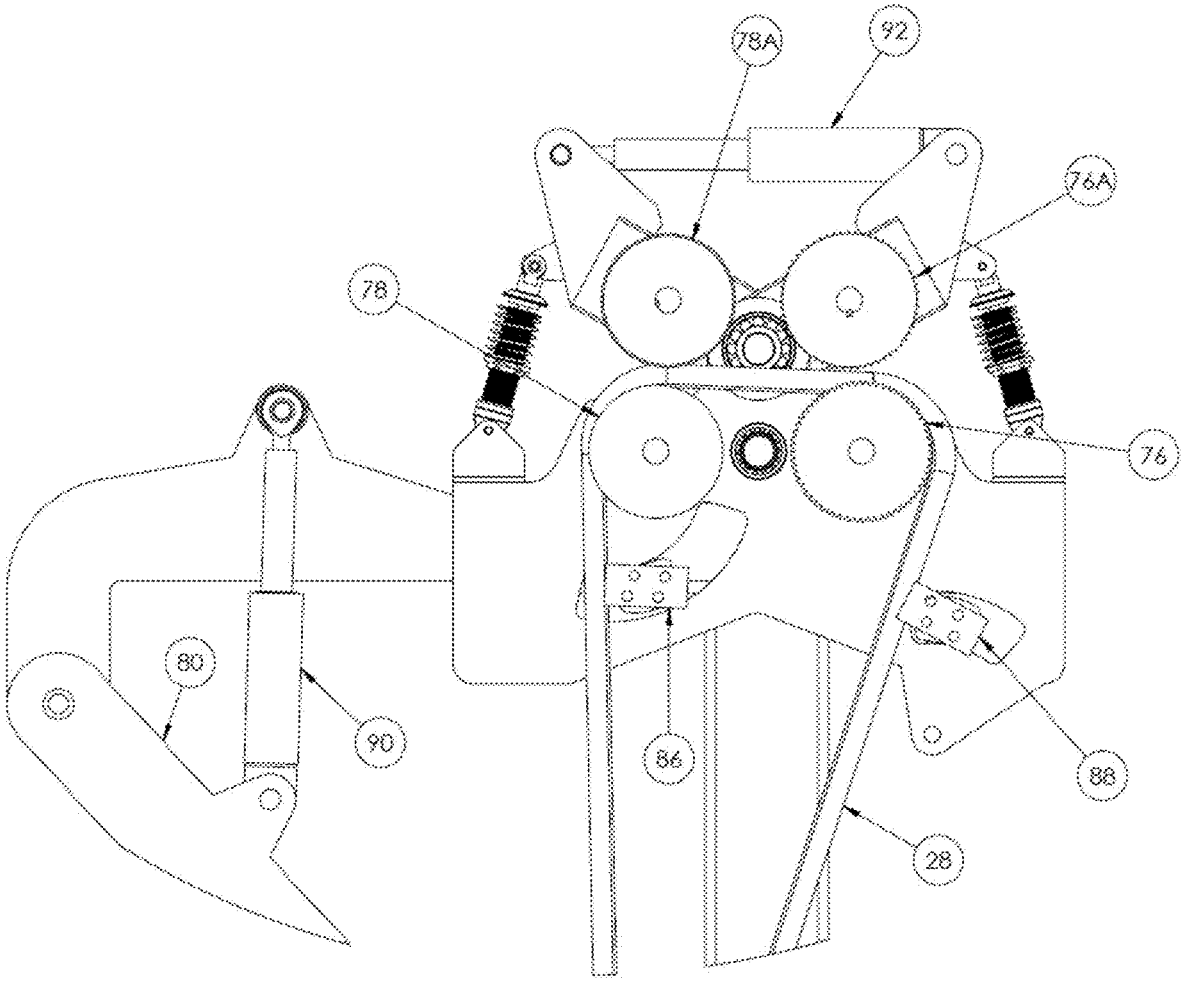
FIG. 8D is another partial side view of an example bead stripper, according to some embodiments.

Referring now to FIG. 7, the tire processing machine 12 may include a chipper 14. The chipper 14 may be coupled to the tire processing machine 12 proximate to the apparatus 10 for cutting the tire into strips, such that the chipper 14 receives the one or more strips of the tire 26 directly from the cutting device 20 to further cut the one or more strips into pieces. The chipper 14 may include a rotary blade 68. In some embodiments, the strip of tire 26 may be fed into the chipper through a funnel 70 that directs the strip towards the rotary blade 68. The chipper may further include chipper feed rollers 72 that grip the strip of tire 26 and ensure the strip of tire is fed into the rotary blade 68 at a relatively constant speed and/or angle.

In some embodiments, the rotary blade 68 and/or the feed rollers 72 are maintained at a constant rotary speed. In other embodiments, the rotary blade 68 and/or the feed rollers 72 may include a variable speed drive motor. The speed of the rotary blade 68 and/or the feed rollers 72 may be controlled by the control system 24 via control panel 25. The rotary blade may include at least one rotary blade 68 and least one stationary blade 74. The strip of tire 26 may be directed between the blades by the feed rollers 72 and cut into pieces. The pieces may be discharged from the chipper 14, placed on a conveyor 18, and transported from the tire processing machine 12.

In some embodiments, the conveyor 18 may be coupled to the tire processing machine 12. The conveyor may be coupled directly to the chipper 14. The conveyor speed may be variable. In some embodiments, the conveyor speed is controlled by the control system 24. In some embodiments, the conveyor speed is proportional to the speed of the rotary blade 68 of the chipper 14.

Referring now to FIGS. 8A-8D, The tire processing machine may include a bead stripper 16. The bead stripper 16 may include a roller system that includes two corrugated drive rollers 76, 76A and two drive rollers 78, 78A. The roller system may rotate a bead wire 28, 36 of a tire 26. The bead stripper 16 may include a tension arm 80. The tension arm 80 may include a first end and a second end. The first end may include a tension roller 82 which engages the bead wire. The second end may include a pivot 84.

The tension arm 80 may pivot to provide tension to the bead wire 28, 36. The tension roller and tension arm stretch the bead wire 28, 36 such that the rubber sheath separates from the metal bead wire 28, 36. With tension applied to the bead wire 28, 36, the bead wire is rotated via the corrugated drive rollers 76, 76A and drive rollers 78, 78A. In some embodiments, the bead stripper 16 includes a first knife 86 and a second knife 88. The first knife 86 and the second knife 88 may be positioned to contact the bead wire 28, 36 such that the first knife and the second knife separate the bead wire (not pictured) from the exterior rubber sheath. The first knife 86 and the second knife 88 may be adjustable.

The two corrugated drive rollers 76, 76A, two drive rollers 78, 78A, and tension arm 80 with its tension roller 82 may be operated by the control system 24 or by an independent control system dedicated to controlling operation of the bead stripper 16. In some embodiments, the first knife 86 and the second knife 88 are adjusted automatically by the control system. The first knife and the second knife may also be adjusted manually. The first knife, the second knife, the roller system, and the tension arm may be adjustable to accommodate different sized and shaped bead wires.

The tension arm 80 may include a hydraulic cylinder 90 to provide tension to the bead wire 28, 36 via the tension roller 82. The hydraulic cylinder 90 may controlled by the control system. In some embodiments, the hydraulic systems may be controlled by a separate hydraulic control system. A hydraulic cylinder 92 may be provided to raise and lower the upper corrugated drive roller 76A and drive roller 78A relative to the lower corrugated drive roller 76 and drive roller 78. The upper corrugated drive roller 76A and drive roller 78A may engage to the bead wire 28, 36 by expanding the hydraulic cylinder 92, causing the corrugated drive roller 76A and drive roller 78A to contact the bead wire is pressed between the respective corrugated drive rollers and drive rollers to engage the bead wire and cause it to move and engage with the first knife 86 and the second knife 88 to separate the bead wire from the exterior sheath.

In some embodiments, the control system may be operated from a control panel 94 coupled to the bead stripper. The control system may be operated from a remote location. The control panel 94 may be merged with control panel 25 into a single control panel (not shown).

A method of operating the bead stripper 16 may include placing one of the first bead wire 28 or second bead wire 36 onto the lower corrugated drive roller 76 and the lower drive roller 78. The bead wire may be placed onto the lower rollers 76, 78 as corresponding upper corrugated drive roller 76A and upper drive roller 78A, located above the corrugated drive roller 76 and drive roller 78, respectively, are in a raised position and the tension arm 80 may be in a raised position, such that there is little or no tension on the bead wire. When the bead wire is resting on the corrugated drive roller 76 and drive roller 78 the tension roller 82 disposed within the bead wire loop, the bead stripper 16 may then apply tension to the bead wire 28, 36 by lowering the tension arm 80 such that the bead wire is stretched between the corrugated drive rollers, drive rollers, and tension roller 82.

The upper corrugated drive roller 76A and upper drive roller 78A may be lowered to contact the bead wire 28, 36 such that the bead wire is between the drive rollers and the corresponding lower corrugated drive roller 76 and lower drive roller 78. In some embodiments, the corrugated drive roller 76A, drive roller 78A, and the tension arm 80 with attached tension roller 82 may be operated hydraulically to provide tension to the bead wire. The bead wire may be stretched sufficiently between the rollers that the external rubber sheath separates from the internal wire. In some embodiments, the control system controls the operation of the corrugated drive rollers 76, 76A, drive rollers 78, 78A, and tension arm 80.

In some embodiments, the first knife 86 and the second knife 88 are positioned to contact the bead wire 28, 36. The first knife 86 may be positioned to remove the outer portion of the exterior rubber sheath of the bead wire and the second knife 88 may be positioned to remove the inner portion of the exterior rubber sheath or visa versa as the bead wire rotates between the corrugated drive rollers and drive rollers, and around the tension roller 82. The first knife 86 may be positioned to remove the inner portion of the exterior rubber sheath of the bead wire and the second knife 88 may be positioned to remove the outer portion of the exterior rubber sheath. The first knife 86 and the second knife 88 may be adjustable to contact the bead wire. In some embodiments, the adjustability of the first knife and the second knife may be controlled by the control system. The first knife 86 and the second knife 88 may be adjusted and then remain stationary as the bead wire rotates, such that the exterior rubber sheath contacts the first knife 86 and the second knife 88 to remove the exterior rubber sheath from the interior wire.

Upon removal of the exterior rubber sheath, the corrugated drive rollers and the drive rollers may be controlled to stop rotating by the control system. The tension arm 80 and the corrugated drive roller 76A and drive roller 78A raise so that they are no longer contacting the bead wire. The bead wire 28, 36 may then be removed from the bead stripper 16.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present inventions have been described in detail, it should be understood that the various changes, substitutions, and alterations could be made hereto without departing from the spirit and scope of the invention.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment. It is to be understood that any of the embodiments of the present disclosure, or any portion(s) of any of the embodiments of the present disclosure, may be combined together in any number of different ways.

Similarly, it should be appreciated that in the above description of embodiments, various features are sometimes grouped together in a single embodiment, Figure, or description thereof for the purpose of streamlining the disclosure. This disclosure format, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Description Of Embodiments are hereby expressly incorporated into this Description Of Embodiments, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. It will be apparent to those having skill in the art that changes may be made to the details of the above-described embodiments without departing from the underlying principles set forth herein.

The phrases "connected to," "coupled to," "engaged with," and "in communication with" refer to any form of interaction between two or more entities, including mechanical, electrical, magnetic, electromagnetic, fluid, and thermal interaction. Two components may be functionally coupled to each other even though they are not in direct contact with each other. The term "abutting" refers to items that are in direct physical contact with each other, although the items may not necessarily be attached together.

The word "exemplary" is used herein to mean "serving as an example, instance, or illustration." Any embodiment described herein as "exemplary" is not necessarily to be construed as preferred or advantageous over other embodiments. While the various aspects of the embodiments are presented in the Figures, the Figures are not necessarily drawn to scale unless specifically indicated.

While specific embodiments and applications of the present disclosure have been illustrated and described, it is to be understood that the scope of the appended claims is not limited to the precise configuration and components disclosed herein. Various modifications, changes, and variations which will be apparent to those skilled in the art may be made in the arrangement, operation, and details of the apparatus and systems disclosed herein.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

The invention claimed is:

1. An apparatus for cutting a tire into one or more strips, wherein the tire comprises: a first bead wire, a first sidewall, a tread, a second sidewall, and a second bead wire; the apparatus comprising:

a cutting device comprising a first rotary blade and a second rotary blade, wherein the tire is configured to be positioned between the first rotary blade and the second rotary blade, and wherein the first and second rotary blades cut the tire into the one or more strips;

a positioning system operable to orient the tire between a plurality of lower vertical, horizontal, upper vertical, and intermediate positions, relative to the cutting device;

one or more support rollers, wherein each of the one or more support rollers comprises a concave surface, wherein the one or more support rollers position the tire relative to the cutting device and determine a width of the one or more strips; and a control system, wherein, in operation, the control system controls the operation of the cutting device and the positioning system to reposition the tire relative to the cutting device as the tire is cut into the one or more strips by the cutting device.

2. The apparatus of claim 1, wherein the positioning system comprises:

a first support configured to lift the tire to a first cutting position, wherein the first support comprises a tower, wherein a proximal end of the tower is coupled to the apparatus and a distal end of the tower comprises the first rotary blade of the cutting device;

a second support configured to lift the tire from a first cutting position to a second cutting position, wherein the second support comprises a plurality of rollers, wherein the tire rests on the plurality of rollers when the tire is in the second cutting position; and a third support configured to lift the tire from the second cutting position to a third cutting position, wherein the third support comprises a plurality of adjustable rollers configured to couple to the second bead wire of the tire.

3. The apparatus of claim 2, wherein the plurality of rollers are individually controlled such that the position of an individual roller is independently adjustable.

4. The apparatus of claim 2, wherein the third support comprises a bead support plate, wherein the bead support plate slideably adjusts to control cutting of the second sidewall without cutting the second bead wire of the tire.

5. The apparatus of claim 1, wherein the cutting device continuously cuts the tire into the one or more strips as the positioning system moves the tire between the plurality of lower vertical, horizontal, upper vertical, and intermediate positions.

6. The apparatus of claim 1, wherein the cutting device moves between the plurality of lower vertical, horizontal, upper vertical, and intermediate positions relative to the tire and the tire is configured to rotate between the blades.

7. The apparatus of claim 1, wherein the tire is static and the cutting device moves between the plurality of lower vertical, horizontal, upper vertical, and intermediate positions relative to the tire.

8. The apparatus of claim 1, wherein the one or more support rollers are configured to maintain a position of the tire relative to the cutting device such that the tire is cut into the one or more strips having a relatively consistent width.

9. The apparatus of claim 1, wherein the location of the one or more support rollers relative to the cutting device is adjustable to accommodate different tire sizes.

10. The apparatus of claim 1, further comprising a chipper, wherein the chipper comprises a rotary blade and receives the one or more strips of the tire from the cutting device and further cuts the one or more strips into chips.

11. The apparatus of claim 10, wherein the chipper further comprises a variable speed drive motor.

12. The apparatus of claim 1, further comprising a bead stripper, wherein the bead stripper comprises:

a roller system comprising two drive rollers and two corrugated drive rollers, wherein the roller system rotates a bead wire of a tire, wherein the bead wire is encased within an exterior rubber sheath;

a tension arm, comprising a first end and a second end, wherein the first end comprises a tension roller and the second end comprises a pivot, wherein the tension arm pivots to provide tension to the bead wire;

a first knife and a second knife positioned to contact the bead wire such that the first knife and the second knife separate the exterior rubber sheath from the bead wire.

* * * * *